US011849527B2

(12) United States Patent
Kim

(10) Patent No.: US 11,849,527 B2
(45) Date of Patent: Dec. 19, 2023

(54) OVEN APPLIANCE WITH IMPROVED CONVECTION COOKING PERFORMANCE

(71) Applicant: Haier US Appliance Solutions, Inc., Wilmington, DE (US)

(72) Inventor: Seog-Tae Kim, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 80 days.

(21) Appl. No.: 17/175,729

(22) Filed: Feb. 15, 2021

(65) Prior Publication Data

US 2022/0264710 A1 Aug. 18, 2022

(51) Int. Cl.
*H05B 6/64* (2006.01)
*F24C 15/32* (2006.01)
*H05B 6/76* (2006.01)

(52) U.S. Cl.
CPC ..... *H05B 6/6473* (2013.01); *F24C 15/322* (2013.01); *H05B 6/76* (2013.01)

(58) Field of Classification Search
CPC ..... H05B 6/76; H05B 6/6473; H05B 6/6485
See application file for complete search history.

(56) References Cited

U.S. PATENT DOCUMENTS 4,304,974 A * 12/1981 Ikeda ..... H05B 6/6485 219/685
5,371,343 A * 12/1994 Yoshimura ..... H05B 6/6411 219/754
2001/0004069 A1* 6/2001 Kim ..... H05B 6/6473 219/400
2004/0134908 A1* 7/2004 Jeong ..... F04D 25/082 219/757
2018/0119961 A1* 5/2018 Yamashita ..... F24C 7/02
2018/0152996 A1* 5/2018 Carcano ..... F24C 15/325

FOREIGN PATENT DOCUMENTS

DE 3117171 A1 * 11/1982
DE 3118463 A1 * 11/1982
DE 3118463 C2 6/1988
(Continued)

*Primary Examiner* — John J Norton
*Assistant Examiner* — Franklin Jefferson Wang
(74) *Attorney, Agent, or Firm* — Dority & Manning, P.A.

(57) ABSTRACT

An oven appliance for providing convection and microwave heating includes a cabinet having a chamber positioned within the cabinet. The chamber is configured for receipt of food items for cooking and has a plurality of walls including a top wall, a bottom wall, a back wall, and opposing sidewalls defining the chamber. At least one of the plurality of walls defines a plurality of apertures and a first duct in fluid communication with the chamber through the plurality of apertures. The oven appliance also includes at least one convection heating element for heating the chamber. Further, the oven appliance includes a convection fan in fluid communication with the first duct. The convection fan is operable to cause air to flow out of the apertures. Moreover, the oven appliance includes a convection motor having a motor shaft. The convection motor is operably coupled to the convection fan for rotating the convection fan about the motor shaft. The convection fan is electrically separated from the convection motor to prevent microwave energy from leaking from the apertures.

11 Claims, 6 Drawing Sheets

(56) References Cited

FOREIGN PATENT DOCUMENTS

| | | | | | |
|---|---|---|---|---|---|
| DE | 102014114292 | A1 | * | 4/2016 | ..... F04D 29/10 |
| EP | 0429822 | B1 | | 7/1994 | |
| EP | 2136605 | B1 | | 2/2015 | |
| JP | 2010276191 | A | | 12/2010 | |
| KR | 200225558 | U | * | 2/1999 | |
| KR | 20040061136 | A | | 7/2004 | |
| KR | 20060097994 | A | * | 9/2006 | |

* cited by examiner

OVEN APPLIANCE WITH IMPROVED CONVECTION COOKING PERFORMANCE

FIELD OF THE INVENTION

The present subject matter relates generally to oven appliances and more particularly to oven appliances having improved convection cooking performance.

BACKGROUND OF THE INVENTION

Oven appliances generally include a cabinet with a cooking chamber positioned therein. The cooking chamber is configured for receipt of food articles for cooking. The oven appliance also includes a heating element for generating heat energy for cooking. The heating element can be, e.g., an electric resistance element or a gas burner. Certain oven appliances also include features for forcing movement of heated air within the cooking chamber. Such oven appliances are generally referred to as convection ovens.

In typical conventional ovens, heated air within the cooking chamber can be circulated with a fan when in a convection mode. The fan initiates a flow of heated air through a plurality of slots in a top wall of the oven's cabinet. The heated air exiting the slots in the top wall generally flows in a vertical direction. Such a configuration distributes heat energy evenly to food articles cooking on a top rack within the cooking chamber. However, food articles cooking on a lower rack disposed below the top rack generally do not receive the benefits of the flow of heated air because the top rack or items disposed on the top racks prevent the flow of heated air from continuing to the lower rack. Thus, when cooking food items on both the top and lower racks the benefits of convection oven may be limited to the food items disposed on the top rack.

In certain other convection ovens, the fan initiates a flow of heated air through a plurality of slots in a sidewall or a back wall of the oven's cabinet. The heated air exiting the slots in the sidewall or back wall generally flows in a horizontal direction. Such a configuration may distribute heat energy more evenly to both the top rack and the lower rack disposed below the top rack compared to the configuration described above. However, variations within the flow of heated air exiting the slots, e.g., due to slot size, slot configuration, or fan speed, can lead to uneven cooking. Also, heated air flowing from a back to a front of a food article may cause the back of the food article to cook more quickly than the front of the food article. Similarly, heated air impacting edges of a food article may cause the edges to cook more quickly than a center of the food article.

Accordingly, for better performance of convection cooking, hot air from the convection heater should be transferred efficiently to the food in the cavity. In particular, in instances in which the product is equipped with a microwave heating system, convection air holes are very small, thereby causing increased air resistance. To reduce the air resistance through the convection air holes, the air holes need to be larger. However, if the air holes are too large, the microwave energy impact can damage components of the oven appliance (e.g., the convection fan, the convection motor shaft, etc.). Moreover, in cases where the motor shaft of the convection motor is metal and large convection holes are present, microwave energy may leak toward the outside of the product, which can impact critical issues, such as noise, etc.

Accordingly, an oven appliance with features for improved convection cooking would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present disclosure is directed to an oven appliance for providing convection and microwave heating. The oven appliance includes a cabinet having a chamber positioned within the cabinet. The chamber is configured for receipt of food items for cooking and has a plurality of walls including a top wall, a bottom wall, a back wall, and opposing sidewalls defining the chamber. At least one of the plurality of walls defines a plurality of apertures and a first duct in fluid communication with the chamber through the plurality of apertures. The oven appliance also includes at least one convection heating element for heating the chamber. Further, the oven appliance includes a convection fan in fluid communication with the first duct. The convection fan is operable to cause air to flow out of the plurality of apertures. Moreover, the oven appliance includes a convection motor having a motor shaft. The convection motor is operably coupled to the convection fan for rotating the convection fan about the motor shaft. In addition, the convection fan is electrically separated from the convection motor to prevent microwave energy from leaking from the plurality of apertures.

In another aspect, the present disclosure is directed to an oven appliance for providing convection and microwave heating. The oven appliance includes a cabinet having a chamber positioned within the cabinet. The chamber is configured for receipt of food items for cooking and has a plurality of walls including a top wall, a bottom wall, a back wall, and opposing sidewalls defining the chamber. At least one of the plurality of walls defines a plurality of apertures and a first duct in fluid communication with the chamber through the plurality of apertures. The oven appliance also includes at least one convection heating element for heating the chamber. Further, the oven appliance includes a convection fan in fluid communication with the first duct. The convection fan is operable to cause air to flow out of the plurality of apertures. Moreover, the oven appliance includes a convection motor having a motor shaft. The convection motor is operably coupled to the convection fan for rotating the convection fan about the motor shaft. In addition, the oven appliance includes a coupler secured to the convection fan and an oven-side end of the motor shaft. Further, the coupler is constructed of a non-conductive material. As such, the non-conductive material of the coupler prevents microwave energy from leaking from the plurality of apertures.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
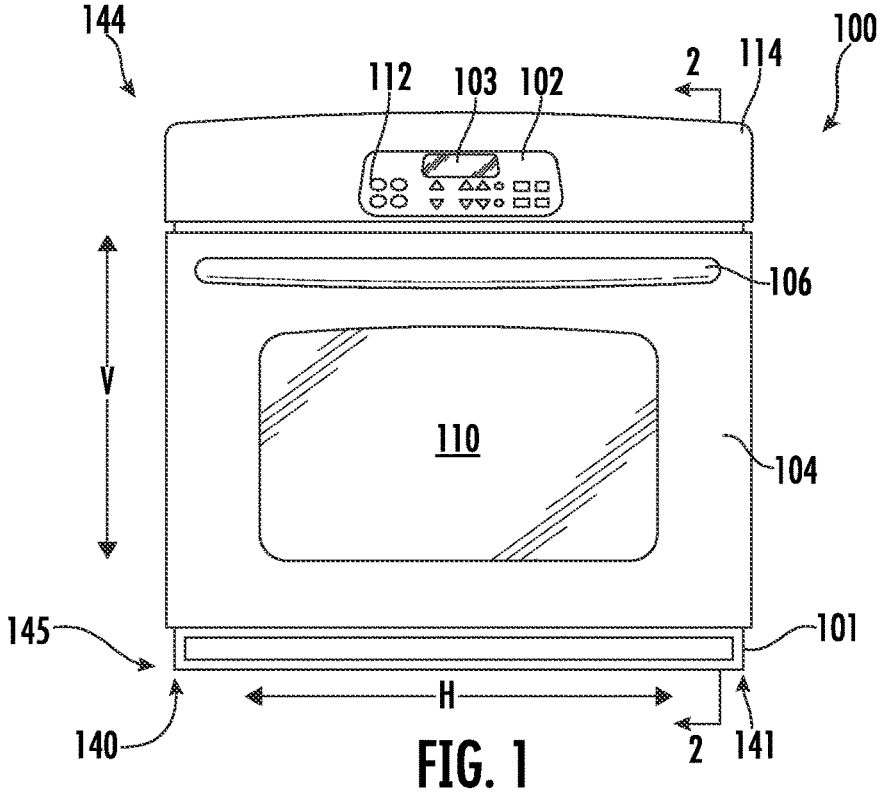
FIG. 1 provides a front view of an oven appliance according to an exemplary embodiment of the present subject matter.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
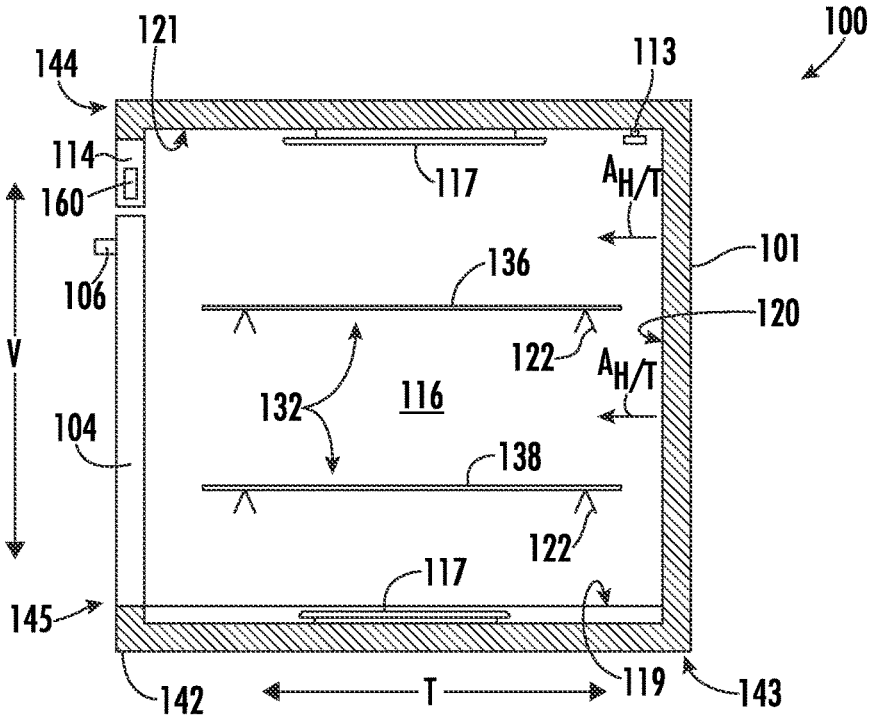
FIG. 2 provides a cross-sectional view of the oven appliance taken along the 2-2 axis of FIG. 1.

Referring to FIGS. 1 and 2, an exemplary embodiment of an oven appliance 100 for providing convection and microwave heating is shown according to the present disclosure. In particular, FIG. 1 provides a front view of the oven appliance 100. FIG. 2 provides a cross-sectional view of the oven appliance 100 taken along the 2-2 axis shown in FIG. 1. The oven appliance 100 includes a cabinet or housing 101 with a cooking chamber 116 positioned therein.

The cabinet 101 extends between a first side 140 (FIG. 1) and a second side 141 (FIG. 1) along a horizontal direction H. Further, the cabinet 101 also extends between a front 142 (FIG. 2) and a back 143 (FIG. 2) along a transverse direction T. The cabinet 101 further extends between a top 144 and a bottom 145 along a vertical direction V. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Moreover, the chamber 101 has interior walls including opposing sidewalls 118, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the horizontal direction and also extends between top wall 121 and bottom wall 119 along the vertical direction V.

Sidewalls 118 include supports 122 (FIG. 2) for supporting oven racks 132 (FIG. 2) that may be selectively positioned within chamber 116. Oven racks 132 include a top rack 136 and a bottom rack 137. Top rack 136 is positioned above bottom rack 137 along the vertical direction V.

The oven appliance 100 also includes a door 104 with handle 106 that provides for opening and closing access to a cooking chamber 116. A user of the oven appliance 100 can place a variety of different items to be cooked in chamber 116 onto racks 132. Heating elements 117 may be positioned at the top and the bottom of chamber 116 to provide heat for cooking and cleaning. Such heating element(s) can be e.g., gas, electric, microwave, or a combination thereof. Other heating elements (not shown) could be located at other locations as well. A window 110 on door 104 allows the user to view e.g., food items during the cooking process.

Referring to FIG. 1, the oven appliance 100 includes a user interface 102 having a display 103 positioned on top panel 114 with a variety of controls 112. In certain embodiments, the interface 102 allows the user to select various options for the operation of oven appliance 100 including e.g., temperature, time, and/or various cooking and cleaning cycles. Operation of the oven appliance 100 can be regulated by a controller 160 (FIG. 2) that is operatively coupled i.e., in communication with, user interface panel 102, heating element(s), and other components of oven appliance 100 as will be further described.

For example, in response to user manipulation of the user interface panel 102, the controller 160 can operate heating element(s). The controller 160 can receive measurements from a temperature sensor 113 (FIG. 2) placed in cooking chamber 116 and e.g., provide a temperature indication to the user with display 103. By way of example, the controller 160 may include a memory and one or more processing devices such as microprocessors, CPUs, or the like, such as general or special purpose microprocessors operable to execute programming instructions or micro-control code associated with operation of appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 160 may be positioned in a variety of locations throughout appliance 100. Thus, the controller 160 may be located under or next to the user interface 102 or otherwise within top panel 114. In an exemplary embodiment, input/output ("I/O") signals are routed between the controller 160 and various operational components of appliance 100 such as heating element(s), controls 112, display 103, sensor(s), alarms, and/or other components as may be provided. In one exemplary embodiment, the user interface panel 102 may represent a general purpose I/O ("GPIO") device or functional block.

Although shown with touch type controls 112, it should be understood that controls 112 and the configuration of the oven appliance 100 shown in FIG. 1 is provided by way of example only. More specifically, user interface 102 may include various input components, such as one or more of a variety of electrical, mechanical, or electro-mechanical input devices including rotary dials, push buttons, and touch pads. The user interface 102 may include other display components, such as a digital or analog display device designed to provide operational feedback to a user. The user interface 102 may be in communication with the controller 160 via one or more signal lines or shared communication busses. Also, the oven appliance 100 is shown as a wall oven but the present invention could also be used with other appliances such as e.g., a stand-alone oven, an oven with a stove-top, and other configurations as well.

In another embodiment, the oven appliance 100 may be equipped with features for selectively generating a forced flow of heated air within the cooking chamber 116 (e.g., using a fan(s) as discussed in greater detail below). Thus, the oven appliance 100 is generally referred to as a convection oven. Such a flow of heated air can, e.g., decrease the required cooking temperature for food items, decrease the amount of time needed to cook food items, or assist in cooking food items more evenly.

Figure 3:
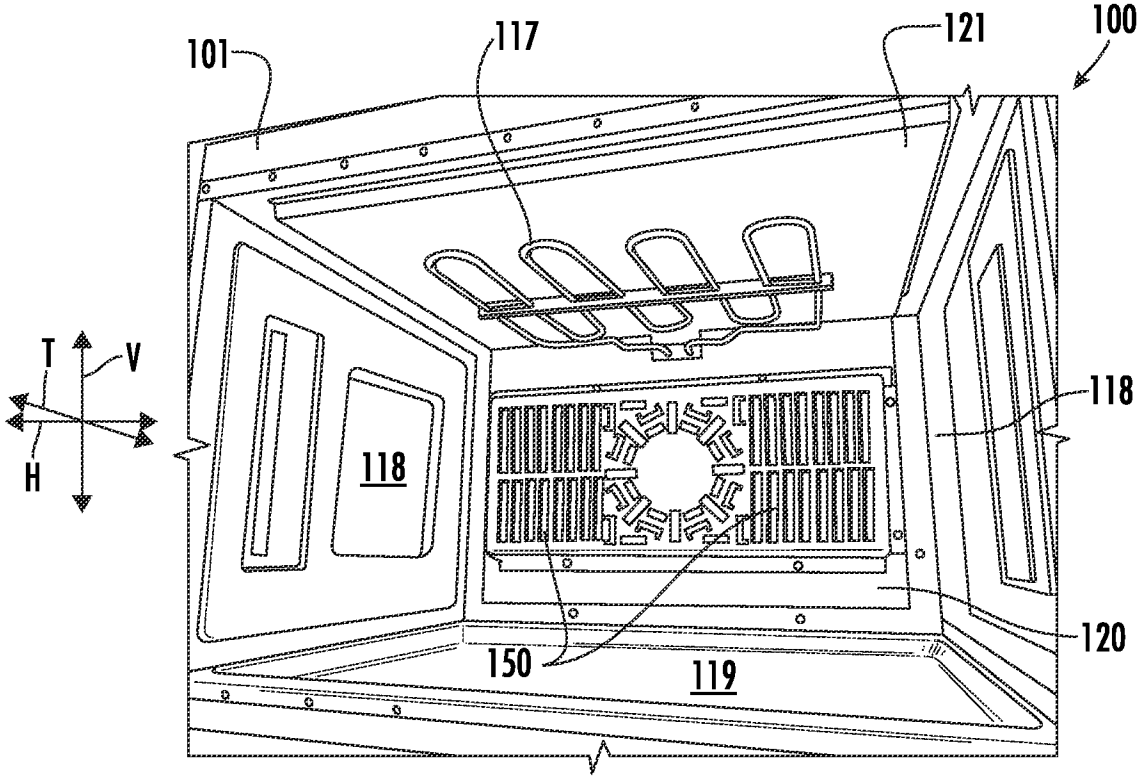
FIG. 3 provides a front perspective view of the oven appliance of FIG. 1 with a door of the oven appliance removed to reveal a cooking chamber and, in particular, to reveal a plurality of apertures defined in a back wall of the appliance.
Figure 4:
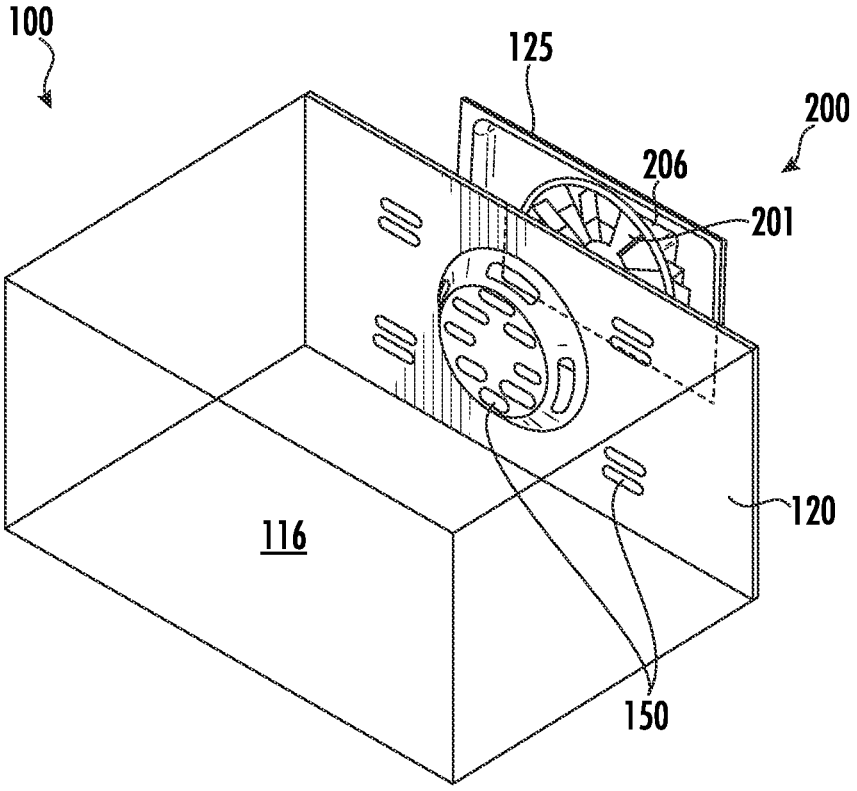
FIG. 4 provides a perspective, schematic view of one embodiment of an oven appliance according to the present disclosure, particularly illustrating the back wall of the oven appliance configured with a convection chamber assembly.

Referring now to FIGS. 3 and 4, partial, perspective views of the oven appliance 100 are illustrated according to the present disclosure. More particularly, FIG. 3 illustrates a front perspective view of the oven appliance 100 with the door 104 removed according to the present disclosure. FIG. 4 illustrates a perspective, schematic view of the oven appliance 100 according to the present disclosure, particularly illustrating the back wall 120 of the oven appliance 100 configured with a convection chamber assembly 200. As may be seen in FIGS. 3 and 4, the back wall 120 defines a plurality of vents or apertures 150. As such, the plurality of apertures 150 is configured for directing a flow of heated air flow shown generally as $A_{H/T}$ (FIG. 2). Thus, the flow of air AH/T exits the plurality of apertures 150 flowing generally along the transverse direction T. However, in alternative exemplary embodiments, the plurality of apertures 150 may be defined in sidewalls 118 such that the flow of air $A_{H/T}$ exits the plurality of apertures 150 flowing generally along the horizontal direction H.

Moreover, the plurality of apertures 150 may have any suitable geometry and/or size. For example, as shown in FIG. 3, the plurality of apertures 150 may be elongated slots. Alternatively, the plurality of apertures 150 may be circular, triangular, oval, or any other suitable shape or combination of shapes. Further, the plurality of apertures 150 may each define a maximum dimension up to about 50 millimeters (mm) to allow convection air to flow out of the plurality of apertures 150. In such embodiments, the plurality of apertures 150 are large enough to provide sufficient convection heating to food items in the oven appliance 100.

In alternative exemplary embodiments, as will be understood by those skilled in the art, louvers, or slats (not shown) may be mounted adjacent the plurality of apertures 150. The louvers are configured for redirecting airflow, e.g., flow $A_{H/T}$. For example, the louvers can more evenly direct flow $A_{H/T}$ throughout cooking chamber 116.

Figure 5:
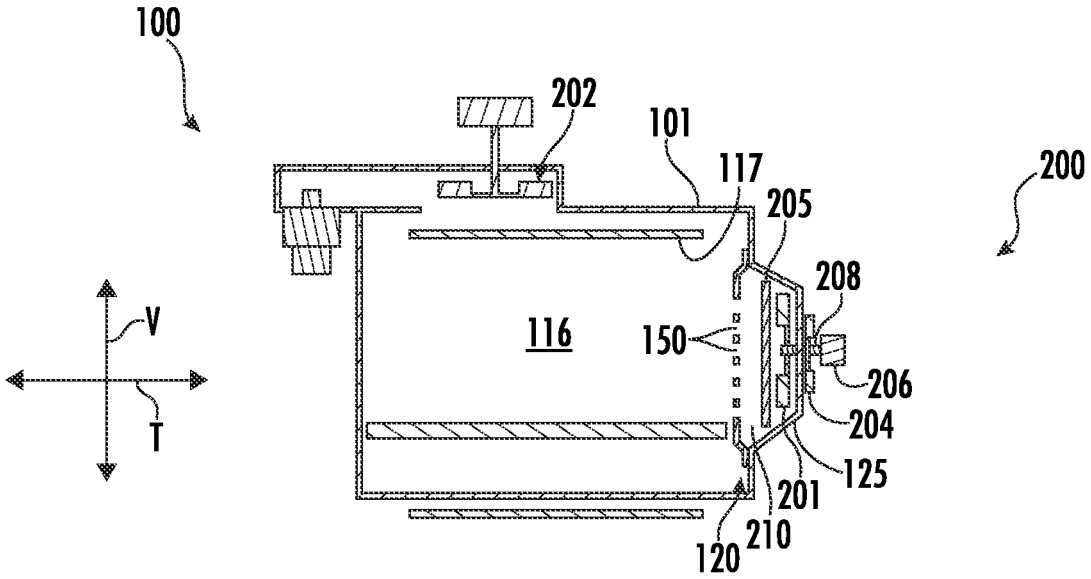
FIG. 5 provides a schematic diagram of one embodiment of an oven appliance according to the present disclosure, particularly a convection chamber assembly thereof.

Referring now to FIGS. 5-9, various views of different embodiments of the oven appliance 100, and more particularly the convection chamber assembly 200, are illustrated according to the present disclosure. More particularly, as shown in FIG. 5, the oven appliance 100 may include a plurality of fans. For example, in an embodiment, the oven appliance 100 may include a convection fan 201 mounted to cabinet 101 adjacent back wall 120, the top wall 121, or one of the opposing sidewalls 118, a cooling fan 204 positioned with the convection fan 201 (e.g., on the same motor shaft), and a stirrer fan 202 mounted atop the cabinet 101. Further, as shown in the illustrated embodiment of FIG. 5, the convection chamber assembly 200 may be positioned adjacent to the back wall 120 with the convection fan 201 being an axial fan 201. In further embodiments, the convection chamber assembly 200 (and therefore the convection fan) may be positioned within a manifold 203 (FIG. 6) defined in a convection cover 125. Thus, in alternative embodiments, the convection chamber assembly 200 may also be secured to the top wall 121.

Further, as shown, the convection fan 201 is in fluid communication with at least one first duct 210 defined by the cabinet 101, one of the walls (such as the back wall 120 or the top wall 121), a convection heating element or heater 205, and the convection cover 125. Accordingly, the convection fan 201 is operable to cause air to flow through the first duct 210 and out of the plurality of apertures 150. Moreover, in an embodiment, as shown in FIGS. 5 and 6, the convection heater 205 may be positioned within the convection cover 125 adjacent to the convection fan 201, outside of the convection cover 125 (e.g., on an opposing side of the apertures 150), and/or adjacent to the back wall 120 and/or the top wall 121.

As will be understood by those skilled in the art, other suitable configurations for the first duct 210 may be provided. For example, additional boundary walls may be provided spaced apart from the cabinet 101 and the walls of chamber 116. Also, the first duct 210 may be constructed of piping or other similar conduits for air disposed between the cabinet 101 and the walls of chamber 116 or outside of cabinet 101. As may be seen in FIGS. 5 and 6, the first duct 210 is in fluid communication with the plurality of apertures 150 defined in back wall 120. Accordingly, the convection fan 201 is in fluid communication with the plurality of apertures 150 through the first duct 210. Thus, the convection fan 201 is configured for selectively rotating in a direction of rotation for moving air throughout the chamber 116. In particular, the convection fan 201 urges heated air through the first duct 210 to the plurality of apertures 150 where such air exits the plurality of apertures 150 and into the chamber 116.

Figure 6:
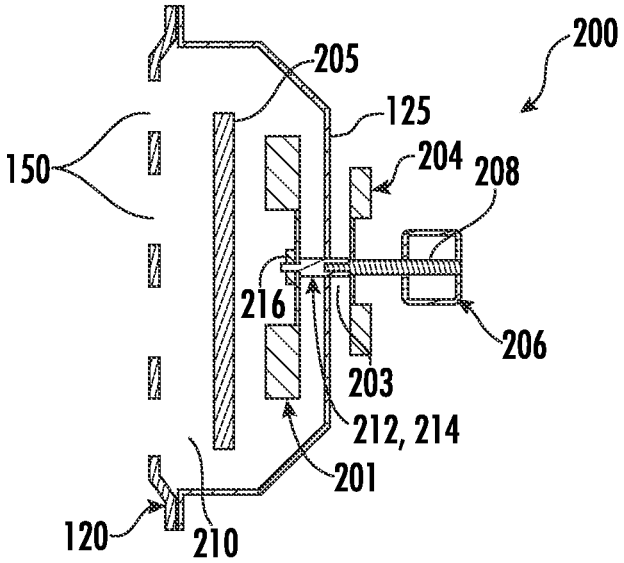
FIG. 6 provides a schematic diagram of one embodiment of a convection chamber assembly of an oven appliance according to the present disclosure.

Still referring to FIGS. 5 and 6, the oven appliance 100 also includes a convection motor 206 having a motor shaft 208. Further, as shown, the convection motor 206 is operably coupled to the convection fan 201 for rotating the convection fan 201 about the motor shaft 208. In addition, as shown particularly the convection fan 201 is electrically separated from the convection motor 206 to prevent microwave energy from leaking from the plurality of apertures 150. For better performance of convection cooking, hot air from the convection chamber assembly 200 should be transferred efficiently to the food in the chamber 116. In the case of microwave heating, the plurality of apertures are generally very small (e.g., maximum dimension around 5 mm), however, such size causes increased air resistance. Therefore, the present disclosure utilizes a combination of the plurality of apertures 150 being of a larger size (e.g., having a maximum dimension up to about 50 mm) and electrically separating the convection fan 201 and the convection motor 206 to reduce microwave energy leakage.

For example, as shown in FIG. 6, the convection fan 201 may be electrically separated from the convection motor 206 via a non-conductive material 212. In one embodiment, for example, the non-conductive material may be ceramic. More specifically, as shown in FIG. 6, the convection fan 201 is electrically separated from the convection motor 206 via a coupler 214 constructed of the non-conductive material 212. For example, as shown, the coupler 214 is secured to the convection fan 201 and an oven-side end of the motor shaft 208.

Figure 8:
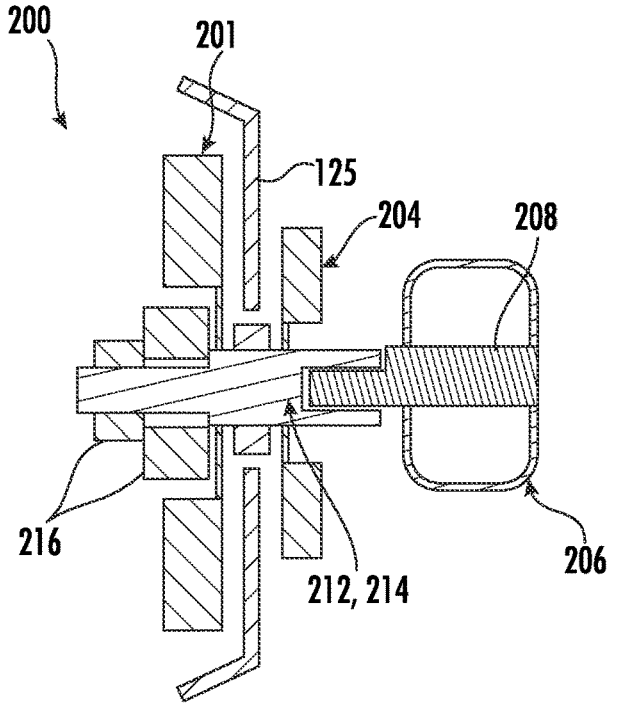
FIG. 8 provides a schematic diagram of still another embodiment of a convection chamber assembly of an oven appliance according to the present disclosure.

In one embodiment, as shown in FIG. 6, the coupler 204 extends up to a cooling fan 204 of the oven appliance 100 but the motor shaft 208, rather than the coupler 214 extends through the cooling fan 204. In an alternative embodiment, as shown in FIG. 8, the coupler 214 extends through the cooling fan 204 of the oven appliance 100. Moreover, as shown in FIGS. 6 and 8, the coupler 214 may be secured to the convection fan 201 using any suitable means, such as e.g., via one or more fasteners 216.

Figure 7:
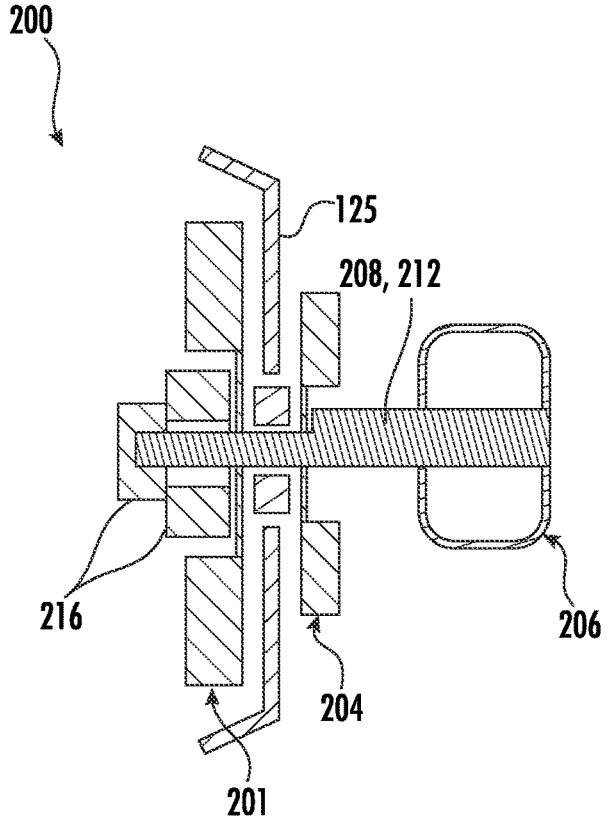
FIG. 7 provides a schematic diagram of another embodiment of a convection chamber assembly of an oven appliance according to the present disclosure.

Referring now to FIG. 7, in alternative embodiments, the convection fan 201 may be electrically separated from the convection motor 206 via the motor shaft 208 itself being constructed, at least in part, of the non-conductive material 212. In such embodiments, as shown, the motor shaft 208 constructed, at least in part, of the non-conductive material 212 may be secured to the convection fan 201 via one or more fasteners 216 (i.e., similar to the coupler illustrated in FIGS. 6 and 8). Furthermore, as shown in FIG. 7, the motor shaft 208 constructed, at least in part, of the non-conductive material 212 may be coupled directly to the convection motor 206.

Figure 9:
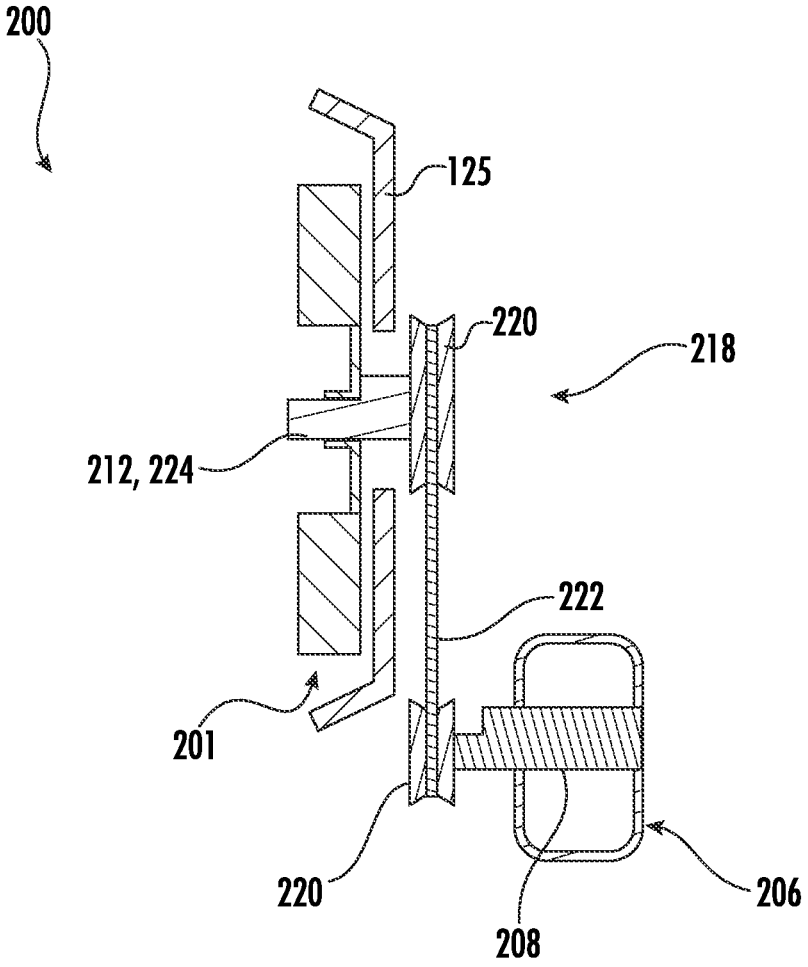
FIG. 9 provides a schematic diagram of yet another embodiment of a convection chamber assembly of an oven appliance according to the present disclosure.

In alternative embodiments, as shown in FIG. 9, the convection fan 201 may be electrically separated from the convection motor 206 via a fan shaft 224 being constructed of the non-conductive material 212. Further, as shown, the fan shaft 224 may be further coupled to a belt and pulley system 218 that is coupled to the convection motor 206. For example, as shown, the belt and pulley system 218 may include one or more pulleys 220 and at least one belt 222 connected to the pulleys 220. Thus, the convection motor 206 may drive the motor shaft 208 that rotates the pulleys 220, thereby rotating the fan shaft 224 constructed of the non-conductive material 212 to drive the convection fan 201.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance for providing convection and microwave heating, comprising:

a cabinet having a chamber positioned within the cabinet, the chamber configured for receipt of food items for cooking;

a plurality of walls comprising a top wall, a bottom wall, a back wall, and opposing sidewalls defining the chamber, at least one of the plurality of walls defining a plurality of apertures, a first duct in fluid communication with the chamber through the plurality of apertures;

at least one convection heating element for heating the chamber;

a convection fan in fluid communication with the first duct, the convection fan operable to cause air to flow out of the plurality of apertures; and a convection motor comprising, at least, a motor shaft, the convection motor operably coupled to the convection fan for rotating the convection fan about the motor shaft, wherein the convection fan is electrically separated from the convection motor via a coupler constructed of a non-conductive material to prevent microwave energy from leaking from the plurality of apertures, the coupler secured directly to a rotor of the convection fan and a first end of the motor shaft, wherein the coupler extends up to a cooling fan of the oven appliance and the motor shaft extends through the cooling fan.

2. The oven appliance of claim 1, wherein the non-conductive material comprises ceramic.

3. The oven appliance of claim 1, wherein the coupler is secured to the convection fan and an oven-side end of the motor shaft.

4. The oven appliance of claim 1, wherein the coupler is secured to the convection fan via one or more fasteners.

5. The oven appliance of claim 1, wherein the plurality of apertures each define a maximum dimension up to about 50 millimeters (mm) to allow the air to flow out of the plurality of apertures.

6. The oven appliance of claim 1, wherein the convection fan is an axial fan.

7. The oven appliance of claim 1, wherein the convection fan is positioned adjacent to at least one of the back wall, the top wall, or one of the opposing sidewalls.

8. An oven appliance for providing convection and microwave heating, comprising:

a cabinet having a chamber positioned within the cabinet, the chamber configured for receipt of food items for cooking;

a plurality of walls comprising a top wall, a bottom wall, a back wall, and opposing sidewalls defining the chamber, at least one of the plurality of walls defining a plurality of apertures, a first duct in fluid communication with the chamber through the plurality of apertures;

at least one convection heating element for heating the chamber;

a convection fan in fluid communication with the first duct, the convection fan operable to cause air to flow out of the plurality of apertures;

a convection motor comprising a motor shaft, the convection motor operably coupled to the convection fan for rotating the convection fan about the motor shaft; and a coupler secured directly to a rotor of the convection fan and an oven-side end of the motor shaft, the coupler being constructed of a non-conductive material, wherein the non-conductive material of the coupler prevents microwave energy from leaking from the plurality of apertures, wherein the coupler extends up to a cooling fan of the oven appliance and the motor shaft extends through the cooling fan.

9. The oven appliance of claim 8, wherein the non-conductive material comprises ceramic.

10. The oven appliance of claim 8, wherein the coupler is secured to the convection fan via one or more fasteners.

11. The oven appliance of claim 8, wherein the plurality of apertures each define a maximum dimension up to about 50 millimeters (mm) to allow the air to flow out of the plurality of apertures.

* * * * *